United States Patent [19]

Stavros

[11] 4,287,238

[45] Sep. 1, 1981

[54] PROTECTIVE ATMOSPHERE GAS WIPING APPARATUS AND METHOD OF USING

[75] Inventor: Anthony J. Stavros, Bethlehem, Pa.

[73] Assignee: Bethlehem Steel Corporation, Bethlehem, Pa.

[21] Appl. No.: 139,605

[22] Filed: Apr. 11, 1980

[51] Int. Cl.[3] ..... C23C 1/00; B05C 11/06

[52] U.S. Cl. ..... 427/349; 427/432; 118/63; 118/420; 15/306 A

[58] Field of Search ..... 427/367, 347, 432, 348, 427/349; 118/422, 420, 63; 15/306 A

[56] References Cited

U.S. PATENT DOCUMENTS

| | | | |
|---|---|---|---|
| Re. 19,758 | 11/1935 | Underwood | 427/349 |
| 2,095,537 | 10/1937 | Underwood | 427/349 |
| 3,270,364 | 9/1966 | Steele | 15/306 |
| 3,707,400 | 12/1972 | Harvey et al. | 427/349 |
| 3,828,723 | 8/1974 | Herman | 118/63 |

FOREIGN PATENT DOCUMENTS

| | | | |
|---|---|---|---|
| 2347248 | 4/1975 | Fed. Rep. of Germany | 427/349 |

*Primary Examiner*—Ralph S. Kendall

*Attorney, Agent, or Firm*—Joseph J. O'Keefe; Charles A. Wilkinson

[57] ABSTRACT

A combined gas wiping die and closed protective atmosphere chamber for treating linear material issuing from a molten metal coating bath is provided with gas exit orifices leading from the hood to the external environment. The gas exit orifices have a combined cross sectional area less than the total cross sectional area of the throat of the wiping die. The combined wiping die and protective chamber with limited area exit orifices is used with a wiping gas such as nitrogen or argon. The thickness of molten coatings on linear material wiped with the combined die and protective chamber can be very accurately controlled by changes in wiping gas pressure.

8 Claims, 7 Drawing Figures

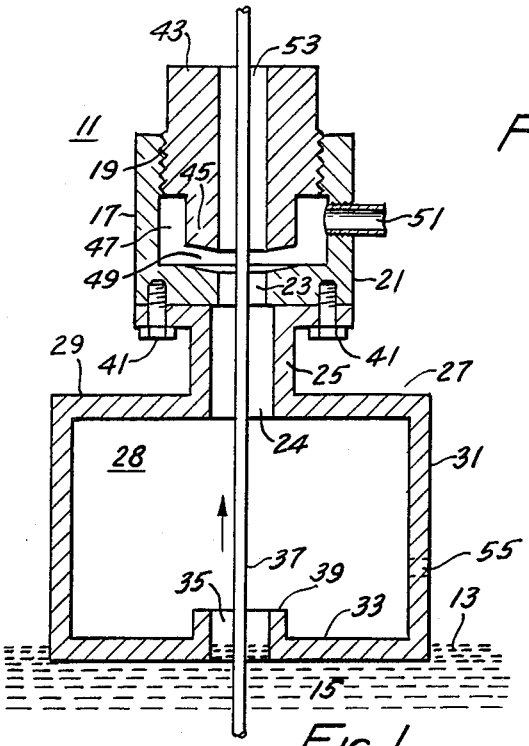
FIG. 1
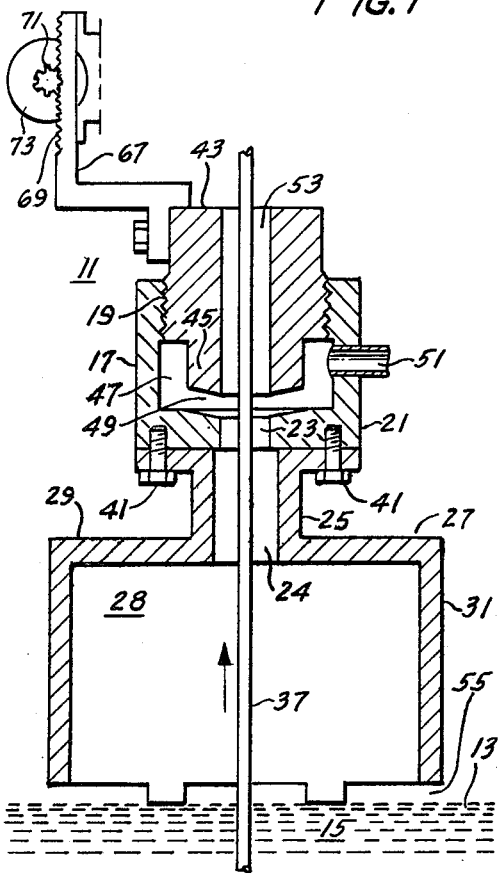
FIG. 2
FIG. 3
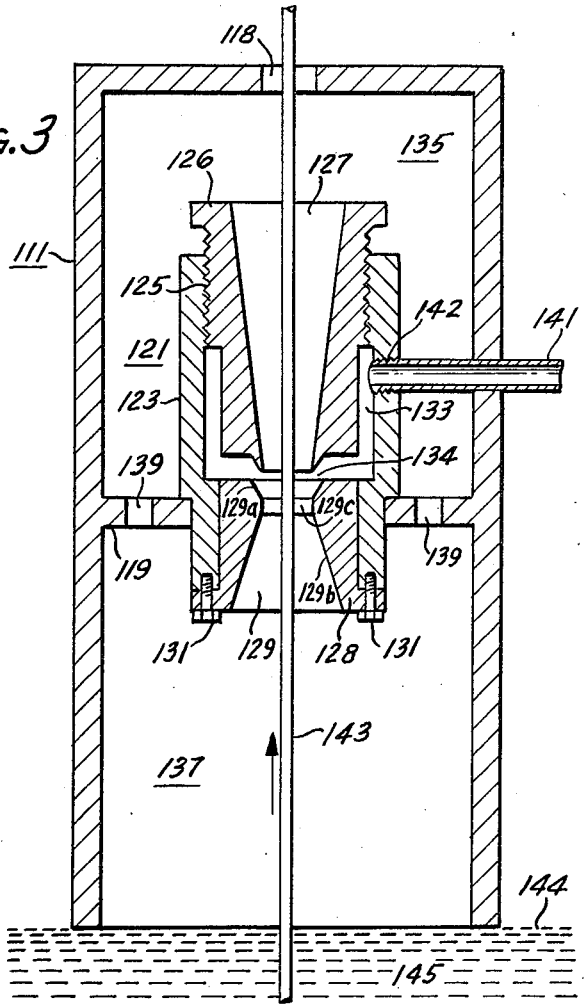
FIG. 6
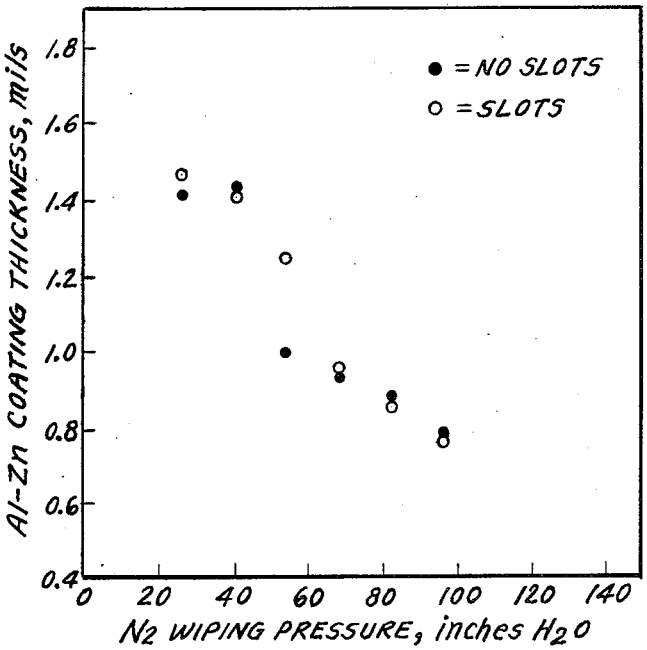

PROTECTIVE ATMOSPHERE GAS WIPING APPARATUS AND METHOD OF USING

BACKGROUND OF THE INVENTION

This invention relates to the coating of linear material such as sheet, strip, and especially wire, with metal coatings in a molten metal coating bath. More particularly the invention relates to the combined use of protective atmospheres and gas wiping in treating linear material issuing from a molten metal coating bath in order to establish an accurate thickness of coating on the surface of the linear material.

Metallic linear material such as sheet, strip and wire has been economically coated for many years by passing the linear material through a bath of molten metal such as molten zinc or aluminum. Usually the linear material has been a ferrous material such as steel or the like. The outer coating of aluminum or zinc or sometimes other metals or alloys such as tin or terne (an alloy of lead with up to 25% tin) provides corrosion resistance to the underlying ferrous metal.

Linear material passing from a molten metal coating bath usually does not have a satisfactory layer of molten coating metal on its surface. The molten metal coating is invariably either too thick, too uneven, or both, or has some other defect which would prevent the molten metal from solidifying into a uniform metal coating upon the substrate metal. As a consequence, it has been customary to wipe the coating in some manner after the linear material leaves the molten coating bath in order to smooth and/or reduce the weight, or thickness, of the coating. Various wiping devices have been used to wipe the coating while it is still molten including soft wipers such as asbestos wipers and the like, rigid wipers such as rolls and scrapers and occasionally semi-rigid wipers composed of layers of various materials such as a charcoal or gravel through which the coated linear material passes. More recently gas wipers, or gas doctors, have been used to blow a gas such as air, steam or some inert or reducing gas forcibly against the surface of the molten metal coated linear material to remove excess metal and smooth the coating of molten metal.

In order to attain good adherence of the coating metal to the substrate metal it is necessary for the surface of the substrate to be clean prior to passage through the molten coating bath. The linear material must, therefore, be cleaned prior to being coated to provide a suitable clean, active substrate surface for contact with the molten coating bath. Otherwise the molten coating will frequently not adhere to the surface. Once the substrate metal is clean it must be kept active, i.e. oxide free, until it is submerged in the molten coating bath. It is therefore necessary to protect the substrate metal after cleaning either with a coating of flux or else by immersion in an inert or reducing atmosphere. Thus, ferrous linear material frequently enters the molten bath from a protective or oxygen excluding atmosphere. The protective atmosphere is composed of either an effectively inert gas or a reducing gas or gases.

Inert or reducing atmospheres have also been maintained about the linear material as it exits from the molten bath to prevent excessive or otherwise detrimental oxidation of the surface of the coating while it is still hot, both before and after the coating solidfies. The protective atmosphere is usually contained in a hood which extends to or into the surface of the molten bath.

With the more recent frequent use of gas wipers for smoothing and wiping molten coatings, the use of an inert or reducing gas to wipe the surface of the linear material has sometimes been adopted to prevent surface oxidation. In some installations, and particularly in wire wiping installations, the wiper has been enclosed in or attached to a chamber containing a protective atmosphere so that the molten coating on the wire leaving the molten coating bath is completely protected from exposure to the atmosphere until it is wiped.

The use of a non-oxidizing gas as both a wiping and a protective gas has been found to be particularly desirable in the wiping of wire material. Otherwise oxidized coating particles on the molten coating surface tend to increase the viscosity of the molten metal and result in buildup of a thick viscous oxide coating layer which seriously interferes with effective gas wiping. The small circumference of the wire allows viscous rings of oxide material to form about the wire and break through the gas barrier resulting in thick rings of coating on the wire. Coatings including such rings crack and flake when the wire is bent after solidification.

One problem which has been encountered in combined wiping and protective gas installations such as, for example, that illustrated in U.S. Pat. No. 3,707,400, which discloses a combined closed hood, which may contain an inert gas, and a wiping die, which may use an inert gas as a wiping gas, has been a tendency of the wiping die to provide very poor control of the thickness of the final coating if only the force of the wiping gas is depended upon to establish the thickness of the coating. This has been so in spite of the fact that such combined wiping and protective gas arrangements very efficiently and effectively wipe excess coating from and smooth linear material such as wire passing through the die. The exact final thickness of coating has often, however, been impossible to control without varying the parameters of the wiping die itself. In other words, while the smoothing of the coating is very effective and a large excess of coating material can be removed from the coated material, actual control of the coating thickness to any specified coating thickness by control of the wiping gas has frequently not been satisfactory. It has thus been necessary in many cases to vary the velocity of passage of the linear material through the wiping die in order to effectively control the degree of wiping of molten coating from the surface of the linear material. If the molten coating layer is too thick, it has been necessary to decrease the speed of passage of the linear material through the die orifice in order to decrease the coating layer. If the coating layer is too thin, on the other hand, it has been necessary to increase the speed of the linear material through the die orifice in order to increase the thickness. Naturally, the necessity to adjust the speed of the coating line in order to attain a desired coating weight is undesirable, because such adjustment interferes with other operational and production considerations.

It has been possible to effectively control the coating weight on linear material passing between gas wiping dies which are not associated with a closed gas hood, for example, by the use of the type of opposed gas wiping dies illustrated in U.S. Pat. No. 3,499,418 to Mayhew, merely by controlling the force of the gas blast or the distance of the gas dies from the surface of the material being wiped. However, when a closed hood has been associated with the die as shown for example in U.S. Pat. No. 3,707,400 mentioned above, effective control of the coating weight has not been found to be conveniently possible merely by varying the flow of wiping gas through the die and impinging upon the surface of the molten coating on the linear material. Instead it has been necessary, as pointed out above, to either vary the speed of the material through the die or else to vary the parameters of die, for example with respect to the length and diameter of the wiping die orifice and the like. This has meant, in effect, that if it is desired to run a coating line at a constant speed different sized dies must be used or substituted for each other each time a significant adjustement in thickness of the final coating has been desired. Such substitution of dies each time an adjustment in coating thickness must be made is obviously impractical.

SUMMARY OF THE INVENTION

The disadvantages of prior combinations of gas wiping dies and protective hoods have now been obviated by the improvement of the present invention. It has been discovered that the use of a correct gas as the wiping and protective gas, i.e. a "heavy" gas such as, for example, nitrogen plus the provision of an orifice or opening from the protective hood to the surrounding environment equal in cross sectional area to less than the cross sectional area of the throat of the wiper die permits the gas wiper to effectively determine the weight of coating remaining on the final coated linear material without regard to the speed of passage of linear material through the wiper die. Strangely, if the total cross sectional area of the orifice or orifices leading from the hood to the external environment is greater than the cross sectional area of the throat of the wiping die, effective wiping and smoothing of the coating will not be attained unless significantly greater gas volumes are used. The invention while applicable to the wiping of many different types of coatings has been found to be particularly useful for wiping molten aluminum-zinc coatings on wire.

DESCRIPTION OF THE FIGURES

FIG. 1 shows in cross section a wire wiper and protective hood combination provided with the improvement of the invention.

FIG. 2 shows in cross section a further embodiment of a gas wiper and protective hood combination in accordance with the present invention.

FIG. 3 shows in cross section an alternative form of gas wiper and protective hood combination in accordance with the present invention.

FIG. 6 is a plot of wiping gas pressure versus final coating thickness using nitrogen as a representative heavy gas with a completely closed protective chamber or hood and for comparison under the same conditions with a protective chamber incorporating the gas exit orifices of the present invention.

DESCRIPTION OF THE PREFERRED EMBODIMENT

Figure 4:
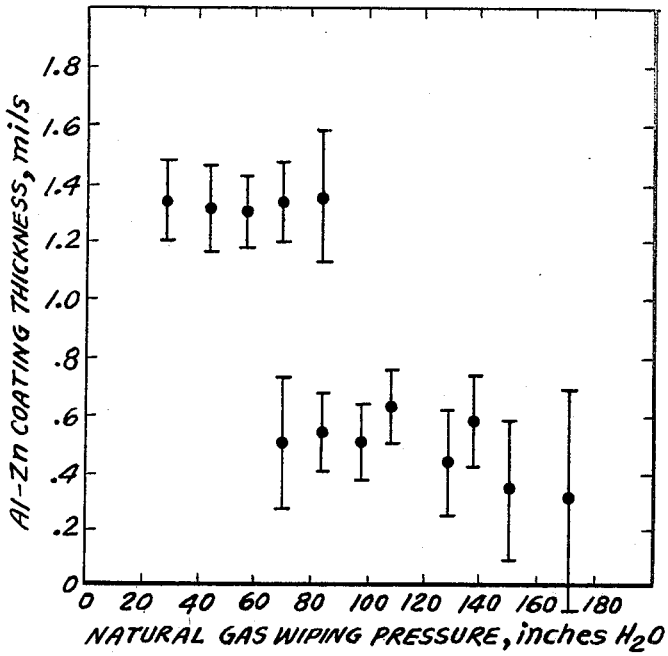
FIG. 4 is a plot of wiping gas pressure versus final coating thickness using natural gas as a representative light gas.

The present invention provides an improved gas wiping arrangement for wiping molten metal coated linear material to both smooth the coating surface and determine the coating weight or thickness. In accordance with the invention, there is provided a gas wiping die which is positioned adjacent to the surface of a molten metal coating bath. The gas wiping die is mounted either within or closely adjacent to and connected with a hood or protective chamber which encloses the linear material as it passes from the molten metal coating bath to the gas wiping die. The protective hood is supplied with an inert or effectively inert gas which serves to protect the surface of the molten coating from oxidation until it reaches the wiping die. Preferably a portion of the surface of the molten coating bath will also be enclosed within the hood to prevent the formation of an oxide film or scum upon the surface of the molten bath.

In order to conserve gas, the inert gas used as a protective blanket for the molten coating is preferably also used as the wiping gas in the wiping die. This gas issues first as a blast of gas through the orifices of the wiping die and wipes the molten coating on the linear material. At least a portion of the expended wiping gas then passes through the throat of the die into the adjoining protective hood where the inert gas or effectively inert gas serves as a protective gas to prevent oxidation of the surface of the molten metal on the linear material and on the surface of the molten coating bath.

In order to allow the inert wiping gas to be used to determine the weight or thickness of the final coating two criteria must be met (1) the wiping gas must be a "heavy" gas such as nitrogen or argon or other similar gas and (2) the protective hood must be provided with an orifice or opening to the atmosphere, or with a series of orifices, the total cross sectional area of which orifice or orifices is less than the total cross sectional area of the throat of the wiping die. The throat of the wiping die may be defined as the orifice, or opening, within a circumferential wiping die through which linear material which is to be wiped passes and into which the blast of wiping gas is directed to impinge upon the surface of the material being wiped. The absolute cross sectional size, or area, of the exhaust orifice or orifices in the protective chamber may vary considerably so long as such area amounts to not more, or preferably slightly less, than the cross sectional area of the throat of the die and is large enough to allow direct exhaust of a significant amount of gas from the chamber. A significant amount of gas may be considered to pass through an orifice having a cross sectional area of from about 5 to 15% of the cross sectional area of the throat of the die on up. It is preferred, however, to have an orifice with a cross sectional area amounting to approximately 20% to 90% of the cross sectional area of the throat of the die, though as noted above the orifice cross sectional area may vary widely and range from about 5% or somewhat less of the cross sectional area of the throat of the die up to nearly 100% of the cross sectional area of the throat of the die. If the orifice is too small the wiping die may only smooth the coating on the linear material, but will not be able to effectively control the coating weight at all desirable values, while if the orifice is too large, the wiping die may neither effectively smooth the coating on the linear material, nor effectively control the coating weight.

The use of a "heavy" gas such as nitrogen or argon has also been found, as noted above, to be necessary for effective control of the thickness or weight of the final coating. The term heavy is used in contradistinction to "light" protective gases such as hydrogen ($H_2$), methane ($CH_4$), natural gas and helium. It has been found that operable heavy gases are nitrogen, argon, propane, carbon monoxide or carbon dioxide. Other "heavy gases" may also be suitable, however. It is theorized at this time that an operable heavy gas can be considered to be one which either has a molecular weight or a density (specific gravity) which is substantially the same or greater than the average molecular weight or density of air. A light gas, on the other hand, is a gas the molecular weight and/or density of which is significantly less than that of air.

In FIG. 1 there is shown diagrammatically in elevated cross section a gas wiping die and protective hood combination broadly similar to the arrangement disclosed in U.S. Pat. No. 3,707,400 to Harvey et al. The die 11 is positioned a predetermined distance from the surface 13 of a molten metal coating bath 15. The die per se is comprised of an outer cylindrical body 17 having internal threads 19 at the upper end within the hollow interior of the cylindrical body. The cylindrical body has a lower end 21 in which there is an orifice 23 leading into a gas passageway 24 through an upper neck portion 25 of a cylindrical gas containment or hood member 27. The orifice 23 constitutes the so-called throat of the wiping die.

The interior of the hood 27 comprises an expanded hollow chamber 28 enclosed within upper walls 29, straight cylindrical side walls 311 and a bottom closure 33 having a central opening 35 through which a wire 37 enters the chamber 27. By expanded hollow chamber it is meant that the chamber is substantially greater in cross section than the passageway 24 leading into it.

Preferably the bottom closure 33 includes an upward cylindrical extension or dam 39 about the central opening 35. The closure member 33 with dam 39 may or may not be used. This closure member is useful, as disclosed more fully in an application being filed contemporaneously with the present application, when the molten bath is composed of a solution or alloy of zinc and aluminum with a fairly high percentage of aluminun or in case the bath contains some other volatilized metallic component and serves to catch solidified particles of the easily volatilized component so that the bath surface is not contaminated.

The cylindrical gas containment or hood member 27 is secured to the bottom of cylindrical body 17 of the die 11 by means of removable machine bolts 41. It will be understood, however, that any other suitable connecting means such as, for example, a threaded connection or the like could be used.

The outer cylindrical body 17 of the die 11 has an inner cylinder 43 threaded into it. The inner cylinder 43 has a depending nose 45 which, when the two cylindrical members 17 and 43 are correctly positioned with respect to each other, defines between its surface and the inner surface of the outer cylindrical body 17 an arcuate circumferential gas passageway 47. The lower portion of this passageway constitutes a circumferential gas wiping orifice 49. The central space about which the circumferential gas wiping orifice 49 extends may be considered to constitute an upward extension of the throat 23 of the gas wiping die.

A gas inlet orifice 51 is disposed in the side of the cylindrical body 17 providing access from the exterior of the wiper 11 to the arcuate passageway 47. The inner cylinder 43 also has a central passageway 53 through which the wire 37 passes upwardly through the wiping die. It may frequently be desirable to have more than one inlet orifice 51 spaced more or less evenly from each other in order to assure uniform gas pressure within the circumferential gas passageway 47.

An exhaust orifice 55 is provided in one side of the side walls 31 of the expanded hollow chamber 28. The cross sectional area of the orifice 55 is not more than the cross sectional area of the throat or orifice 23 of the gas wiping die 11. As disclosed above the actual cross sectional area of the orifice 55 may be from about 5% to a little less than 100% of the cross sectional area of the throat of the die 23, but it is preferred that it have a cross sectional area of between 20% to 90% of the cross sectional area of the throat of the die. Although only a single orifice 55 is shown it will be understood that a plurality of orifices could be used so long as their combined cross sectional areas is not greater than the cross sectional area of the throat 23 of the gas wiping die. Likewise it will be understood that although a generally round or cylindrical orifice is shown in the side walls 31 in FIG. 1 that the orifice or orifices could, in general, be of any shape and might be placed in almost any convenient location in the hood.

In operation the wire 37 passes through the molten metal coating bath in any conventional manner, usually down around a lower sinker sheave, not shown, and then up through the bath surface, through the central opening 35 in the bottom of the closure 33, up through the hollow expanded chamber 28, through the neck 25 of the gas containment hood, via the passageway 24, through the orifice or throat 23, past the circumferential wiping gas orifice 49 and finally upwardly through the central passageway 53 of the inner cylinder and out of the gas wiper.

As the wire passes by the circumferential gas wiping orifice 49 it is wiped by a curtain of gas which has been shaped by the wiping orifice. This blast of gas wipes and smooths the molten coating on the wire. Excess coating is in effect pushed back into the molten coating bath. The gas used is preferably a reducing or effectively inert gas and must be a relatively heavy gas such as, for example, nitrogen, propane or the like. This protective gas is directed downwardly and inwardly at an angle toward the wire to aid the wiping action and at least a portion of the gas passes downwardly into the hollow chamber 28 in the gas containment hood where it additionally serves to protect the molten coating on the wire and the molten surface of the bath from oxidation. Such oxidation would tent to form a coating of oxide on the surface of the bath which could then be drawn upwardly with the molten coating on the wire causing an undesirable roughness on the coated wire and interfering with smooth wiping of the coating. The reducing or inert gas can, since it protects the molten metal from oxidation, be referred to broadly as the protective gas.

It has been found that with the addition of the orifice 55 to the hood 27 the blast of gas impinging upon the surface of the linear material—in the case illustrated a wire—will not only smooth the surface and provide a uniform coating, but that the thickness or weight of the coating can when the orifice is present in the hood be effectively controlled so long as a relatively heavy wiping gas such as nitrogen or argon is used.

In FIG. 2 there is shown diagrammatically a further embodiment of the invention in which the orifices in the protective chamber are in the form of slots adjacent to the surface of the molten bath. This embodiment of the invention has the advantage that when used with an aluminum-zinc coating bath or the like the gas current issuing from the slots serves to also sweep the surface of the molten bath free of precipitated zinc power as described and claimed in the concurrently filed application referred to above. The various parts of the apparatus shown in FIG. 2 are substantially identical to those shown in FIG. 1 except for the location of the slots 55 and thus similar structures have been identified with the same designation numerals as in FIG. 1. For a description of the various parts reference may be had to the description in connection with FIG. 1. The horizontal slots about the bottom of the hood may be discontinuous as shown or continuous about the entire circumference so long as the total cross sectional area of the opening or openings is less than that of the throat of the die. Since the slot openings should be maintained more or less constant in height it is convenient if an adjustment apparatus 65 is available to adjust the height of the chamber above the bath. A bracket 67 is attached to the top of the die and a rachet 69 is attached to the bracket. The racket 69 is in engagement with a pinion 71 on the shaft of adjustment motor 73.

As stated above the two major considerations in obtaining effective wiping of the linear material and particularly wire in the combined wiping die and protective chamber of the invention have been found to be the use of a heavy gas such as nitrogen, argon, propane or the like and the use of an exhaust orifice in the side or the protective chamber. The angle of the wiping die orifice should be between about 5 to 60 degrees with respect to perpendicular to the surface of the linear material passing through the die. In general the greater the orifice angle the thicker the resulting coating.

The preferred die orifice angle is 15 to 30 degrees with a less preferred range of about 10 to 45 degrees. However, as noted above, so long as a heavy gas is used and an orifice or orifices having a combined cross sectional area less than the cross sectional area of the throat of the die are provided in the protective chamber the die angle can be from about 5° to 60°. It has also been found that the size throat in the die, or, more accurately, the distance of the wiping gas orifices from the surface of the wire, and the thickness of the die orifices has an effect upon the efficiency of wiping control by the use of gas pressure variations. For a given wire diameter the smaller the throat diameter of the die the thinner the resulting coating will be. As a practical manner, however, one-half inch appears to be the smallest useful throat diameter for wire wiping dies. The orifice thickness, that is the width of the gas wiping orifices parallel to the length of the wire or in the direction in which the wire is traveling should for best results be 0.005 inch to 0.020 (0.127 to 0.508 millimeter), although an orifice thickness of 0.040 inch (1.016 millimeters) will be quite satisfactory. The length of the orifice should preferably be 0.25 inch (0.635 centimeter) or more and will preferably be as long as practical. The sides of the orifices will in this length also preferably have substantially parallel side walls in order to attain a fairly compact stream of gases from the opening of the orifice to the point at which the wiping gas impinges upon the molten coating upon the linear material, or particularly wire. At least in wiping wire, it has been found that the orifice height above the bath surface should be about 2 inches to 15 inches (5 to 38 centimeters) for best results.

It has rather surprisingly been found that the use of a protective chamber directly interconnected with the wiping die which protective chamber receives the wiping gas and uses such gas as the protective gas not only is economical in using the same gas for two different purposes, but that as compared to an "open" wiper also requires significantly reduced wiping gas flow and pressures. By open die is meant a die which discharges its wiping gas into the atmosphere, i.e. a nonenclosed die, rather than discharging the gas into an enclosed space after such gas has been used for wiping. In other words an open wiping die is a die without significant back pressure. As pointed out above it has also been found, however, that an enclosed die, i.e. one discharging into a closed chamber, exhibits very poor control of coating thickness. By placing an orifice or orifices in the closed chamber, however, the die is surprisingly allowed to wipe and control the coating thickness at the same time so long as the total area of the orifice or orifices is not greater and preferably less than the cross sectional area of the throat of the die. If the orifice is larger than the throat of the die in cross sectional area, control of the coating thickness is lost and in addition the die acts essentially like an open die in that greater gas volumes are required to wipe down and effectively smooth the coating.

In FIG. 3 there is shown an alternative arrangement of a die and hood for the coating of wire. In the FIGURE there is shown a cylindrical hood 111. The hood 111 has an exit orifice 118 in the center of the top of the hood. The hood also has a circumferential bracket 119 in the center having a central opening in which there is mounted a gas wiping die 121 comprised of an outer cylindrical body 123 having internal threads 125 into which is threaded an inner cylindrical member 126 having a central conical throat 127. A cylindrical throat member 128 having an interior passage 129 in the shape of two opposed conical sections **129*a* and 129*b* connected by a central cylindrical section 129*c* is positioned in the bottom of the outer cylindrical body 123 and secured in place by machine bolts 131. It is preferable if the throat member 128 is formed from a wear resistant stainless steel, particularly if the die is used to wipe aluminum-zinc coatings. An annular passageway 133 between the outer cylindrical body 123 and the inner cylindrical member 126 is connected to a circumferential gas wiping orifice 134 which leads to the upper portion of the interior passage 129. The circumferential bracket 119 which supports the wiping die 121 divides the cylindrical hood 111 into an upper chamber 135 and a lower chamber 137. The lower chamber is in direct communication through exhaust orifices 139 with the upper chamber 135. A gas inlet pipe 141 passes through the side of the hood 111 and is threaded into an opening 142 in the outer cylindrical body 123 leading into the annular passageway 133**.

The total cross sectional area of the exhaust orifices 139 and the individual cross sectional area of the exit orifice 118 are each less than the cross sectional area of the narrowest portion **129*c* of the throat 129 of the die 121. Alternatively either the orifices 139 or the exit orifice 118 could be larger than the narrowest portion 129*c* of the throat 129 of the wiping die 121 so long as both are not larger. The circumferential bracket 119 may actually comprise only a structural framework mounting the die 121. In this case the orifice 139 would be either not restricted or in effect nonexistent. In this event the orifice 118 must be restricted in area to less than the cross sectional area of the throat 129** of the die.

In operation a wire 143 passes up through a molten coating bath 145 exiting from the bath surface 144 into the lower chamber 137, thence through the wiping die 121, where it is wiped by a curtain of inert or reducing gas issuing from the circumferential gas wiping orifice 134, and into the upper chamber 137 from which the wire 143 exits through the orifice 118.

At least a portion of the heavy wiping gas after wiping and smoothing the coating on the wire as it passes through the circumferential orifice 134 passes downwardly through the interior passage 129 of the throat member 128 into the lower chamber 137 of the hood 111 where the gas shields the molten coating on the wire and the molten surface 144 of the coating bath 145 from oxidation. The protective gas then passes up through the orifices 139 into the upper chamber 135 where it continues to shield the wire and finally is exhausted through the orifice in the top of the hood. If the wiping and shielding gas, i.e. protective gas, is a reducing gas, it is preferably burned as it passes through the orifice 118. Since the orifices 139 and the orifice 118 provide an exit from the confined hood chambers and the cross sectional areas are less than the cross sectional area of the throat of the die, the thickness or weight of coating can be controlled by varying the pressure of the gas blast applied via the orifice 134 to the wire passing through the die arrangement.

It will be understood that although the orifices 139 and orifice 118 are illustrated with cross sectional areas less than the cross sectional area of the throat 129 of the die and are the only orifices present, one or both sets of these orifices could be made with an even smaller size and additional orifices could be provided to allow exit of additional protective gas directly from either the upper or lower chambers. It will also be understood that some suitable means could be provided to exhaust the inert or protective gas through the orifices into a conduit or the like under the impetus of a forced draft or equivalent so that a back pressure is not induced in the gas. In this case the gas could, after proper filtering or cleaning, be reused or recycled back to the gas wiping die. It is important for the proper operation of the invention that the exhaust shall be effected under substantially free pressure conditions in order to avoid interfering with the effective wiping of the linear material and determining the weight of coating left thereon.

FIG. 4 is a plot of the effect of using a light gas for wiping a molten coating with the apparatus shown in FIG. 1. The coated material was wire. The molten coating was an aluminum-zinc coating. The wiping gas used was natural gas, i.e. principally methane ($CH_4$). The speed of the 0.091 inch diameter wire through the apparatus was 120 feet/minute. The thickness of the final aluminum-zinc coating is shown on the ordinate while the wiping gas pressure is shown on the abscissa in inches of $H_2O$. Each plotted point is shown both with the point and with 95% confidence limits extending upwardly and downwardly from the point. It can be seen that the plot of pressures shows that there is an overlapping area in which a number of thicknesses can be obtained with the same pressure of wiping gas. In other words there is an overlapping wiping region where thickness control is erratic at best.

Figure 5:
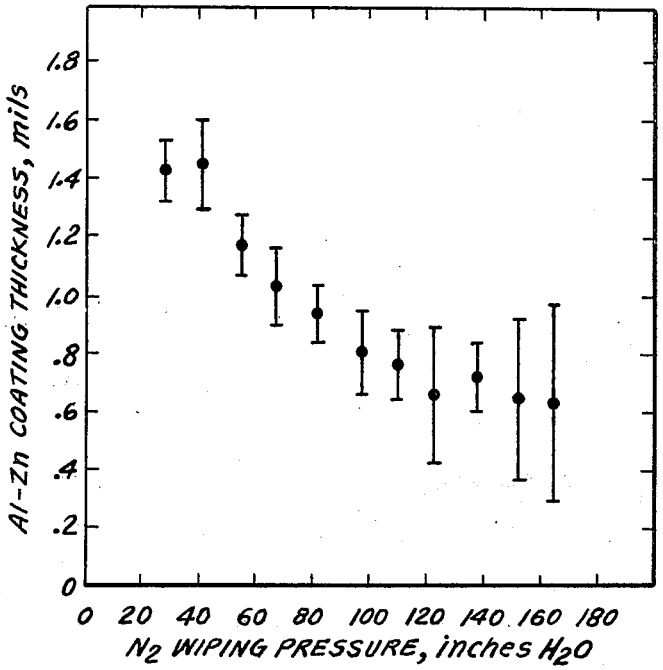
FIG. 5 is a plot of wiping gas pressure versus final coating thickness using nitrogen as a representative heavy gas in accordance with the invention.

FIG. 5 shows a plot similar to FIG. 4 but using a heavy gas as the wiping gas. The wiping gas in this instance was nitrogen ($N_2$). All other parameters were the same as in FIG. 3. It can readily be seen that the overlapping region shown in FIG. 4 is not present in FIG. 5. Instead there is a smooth progression of points at which higher pressures of wiping gas result in thinner and thinner final coatings at least at gas pressures between about 40 inches of water and 120 inches of water of applied pressure. This curve makes adjustment of the thickness of the final coating very controllable by the use of wiping gas pressure only. The principal drawback of the curve from a control standpoint in the range of 40 to 120 inches of water is the steep initial drop of the curve.

FIG. 6 graphically illustrates the effect of the use of the orifice or orifices of the invention in the protective atmosphere chamber or hood, i.e. orifices having a total cross sectional area less than the cross sectional area of the throat of the die. In FIG. 6 there are shown two curves plotted with solid dots and with open circles respectively. The curve plotted with open circles represents the use of slots or orifices in the protective chamber in accordance with the invention using nitrogen as the wiping gas. The apparatus was that shown in FIG. 1. The wire was 0.091 inch in diameter and passed through the die at 120 feet per minute. It will be noted that the resulting curve has a good working slope and a fairly uniform curve. The curve plotted with solid dots, on the other hand, represents data in which all conditions and apparatus were the same as with the open dot curve, including the use of nitrogen as a wiping gas and the same diameter and speed of wire, but in which the wiping apparatus, while otherwise the same as FIG. 1, did not have the slots 55 of the invention in the protective chamber. It will be seen that the curve is distorted particularly in the central portion where there is a very steep drop from the second to the third data point from the left. This sudden drop and short slope below has been found to be typical of these curves and characteristic of the use of a completely closed protective chamber. While not as bad as the overlapping pattern of FIG. 4 obtained with the use of a light gas, the pattern in FIG. 6 is not satisfactory for wiping control by the use of gas pressure along. If either curve in FIG. 6 was continued at the ends, the same flat upper and lower portions as in FIG. 5 would become evident.

Figure 7:
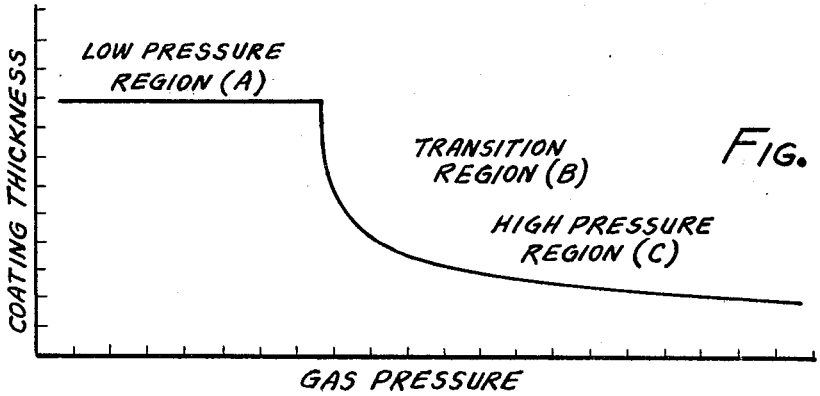
FIG. 7 is a curve illustrating the general relationship of gas wiping pressure to coating thickness in apparatus constructed in accordance with the invention.

In FIG. 7 there is shown a diagrammatic graph of the pressure effects upon wiping efficiency with the coating thickness obtained plotted against the gas pressure applied in the wiping die. The plot is approximate only and no precise or numerical relationships are intended to be shown. The horizontal sections of the curve designated "Low Pressure Region" (A) shows the regions in which the linear material is wiped and smoothed, but the weight of the applied coating is not controlled by varying the pressure. In other words the relation of coating thickness with gas wiping pressure is substantially a straight line. The "Transition Region" (B) on the other hand, is a region in which variation of gas pressure results in varying thicknesses or weights of coating remaining upon the wire or other linear material. It will be noted that the transition region actually is composed of two general subregions the upper portion of which is almost a vertical line indicating extreme changes of coating thickness with small changes in gas pressure and the lower portion of which shows a generally declining coating thickness with increased gas pressure. It is only in the lower half or portion of the transition region in which good control of coating weight with changes in gas pressure are obtained. The high pressure region (C) is one in which the effect of the pressure of the wiping gas upon the final coating weight is minimal. Coating thickness decreases only slowly with rapidly increasing gas pressures. The exact slope and contour of the curve depends upon various factors. The principal factors, however, are the type of gas used, whether a heavy or a light gas, and whether the orifices in the protective chamber, for example, orifices 139 or 118 in FIG. 3, are smaller in cross sectional area than the smallest portion 129*c* of the throat 129 of the wiping die. The effect of the use both of a heavy gas such as nitrogen, argon or propane and relatively small orifices 139 and/or 118 is to decrease the steepness or slope of the lower portion of the transition area "B" while the use of light gases such as hydrogen, methane or the like or orifices relatively larger than the throat of the die is to increase the steepness or slope of the transition region "B" thus reducing the control of coating weight. A very steep or even vertical slope in the transition region "B" will appear to, or will in actuality, give overlapping thickness ranges such as shown in FIG. 4. The provision of the proper sized orifices in particular along with the use of a heavy gas decreases the slope of the transition region curve and thus in effect lengthens the area in which a change in gas pressure will result in a change in thickness. The relationship between the coating thickness and weight and the wiping gas pressure used is thus improved or made more controllable by decreasing the amount of change in the coating weight for any given change in wiping gas pressure.

The important aspects of the invention as set forth above are the use of a so-called heavy gas and a combined wiping die and protective chamber, the protective chamber having gas exit orifices from the interior to the exterior of the chamber with a combined opening area less than the area of the throat of the wiping die. While it is not intended to limit the broad invention to other less important die or operational parameters, it may be said that the invention may be used successfully with wire generally from 0.060 inch to 0.200 inch in diameter, with die angles of from 5 to 60 degrees or even more, with an orifice thickness of from 0.005 inches to 0.040 or even up to 0.080 inches or more, and at a height of 2 to 15 inches above the bath. The orifice length should be generally at least one quarter inches to provide a good directional formation of the wiping gas blast and as indicated above the side walls of the orifice should be substantially parallel. The throat diameter of the die can be from one half inch ($\frac{1}{2}''$) to three quarters ($\frac{3}{4}$) of an inch or even up to as much as one and one quarter ($1\frac{1}{4}$) inches. The speed of wire through the die can be from 50 to 300 feet per minute or even more. These figures and parameters are meant to be illustrative only of known and contemplated effective operating parameters and ranges and not restrictions upon the broad invention. These parameters, furthermore, are obviously applicable only to the wiping of wire material, a use of which the invention has been found to be particularly useful, but to which it is not intended to be restricted.

While this invention has been illustrated and explained, therefore, with reference to specific gas wiping equipment designed for the wiping of round wire and rod material, a use for which the invention has been found to be most useful, it should be understood that other types of linear material could also be wiped in accordance with the invention by the use of properly designed wiping equipment and that various heavy wiping gases in addition to those specifically disclosed can be used.

I claim:

1. Improved apparatus for wiping linear material with a heavy wiping gas comprising:

(a) a containment means for a protective gas surrounding the linear material as it passes from a molten metal coating bath, (b) a gas wiping die surrounding said linear material and having a restricted throat through which the linear material passes, said restricted throat being connected with the interior of the protective gas containment means of (a).

(c) substantially circumferential gas orifice means within the gas wiping die adjacent to the restricted throat of the die said gas orifices being inclined downwardly at an angle with respect to perpendicular to the surface of the linear material of from 5 to 60 degrees, and (d) orifice means in the containment means of (a) having a cross sectional area less than the cross sectional area of the restricted throat and providing a passage for gas from the interior of the containment means to the exterior.

2. The apparatus of claim 1 wherein the cross sectional area of the orifice means is from 5% to just less than 100% of the cross sectional area of the restricted throat of the die.

3. The apparatus of claim 2 wherein the cross sectional area of the orifice means is from about 20% to 90% of the cross sectional area of the throat means.

4. The apparatus of claim 1 wherein the linear material is wire.

5. The apparatus of claim 3 wherein the linear material is wire.

6. The apparatus of claim 3 wherein the orifice means is composed of multiple orifices.

7. In a gas doctor means for wiping molten metal coated linear material including gas containment means into which the exhaust gas from the gas doctor passes through a restricted throat the improvement comprising orifice means in the gas containment means having a cross sectional area less than the restricted throat in the gas doctor means.

8. A method of controlling the coating thickness on linear material issuing from a molten coating bath comprising:

(a) passing said linear material through a gas wiping die having a restricted throat and gas wiping orifices adjacent said throat inclined downwardly at an angle of from 5 to 60 degrees with respect to the perpendicular to the surface of the wire, (b) controlling the coating thickness on the linear material by blowing a heavy gas through the gas wiping orifices onto the molten coating upon the linear material, (c) passing the heavy gas into a protective chamber adjacent to the gas wiping die, (d) allowing the heavy gas to escape from the protective chamber through orifice means in said chamber said orifice means having a cross sectional area less than the cross sectional area of the restricted throat in said gas wiping die.

* * * * *